US006200213B1

(12) United States Patent
Cole

(10) Patent No.: US 6,200,213 B1
(45) Date of Patent: Mar. 13, 2001

(54) COIN DELIVERY, STORAGE AND DISPENSING SYSTEM FOR COIN OPERATED MACHINES AND METHOD FOR SAME

(76) Inventor: Joseph Cole, 4170-103 Distribution Cir., North Las Vegas, NV (US) 89030

( * ) Notice: Subject to any disclaimer, the term of this patent is extended or adjusted under 35 U.S.C. 154(b) by 0 days.

(21) Appl. No.: 09/224,384

(22) Filed: Dec. 31, 1998

(51) Int. Cl.[7] ..... G07D 9/04

(52) U.S. Cl. ..... 453/30; 453/18; 453/31; 453/56; 453/57; 453/63

(58) Field of Search ..... 453/17, 18, 30, 453/31, 56, 57, 63; 222/56

(56) References Cited

U.S. PATENT DOCUMENTS

| | | | | |
|---|---|---|---|---|
| 1,024,057 | * | 4/1912 | Bock | 453/31 |
| 3,288,153 | * | 11/1966 | Ballard et al. | 453/31 |
| 3,695,279 | | 10/1972 | Black et al. . | |
| 3,746,211 | | 7/1973 | Burgess, Jr. . | |
| 3,935,970 | * | 2/1976 | Spaw | 222/56 |
| 4,342,384 | * | 8/1982 | Fukase et al. | 453/56 |
| 4,383,540 | | 5/1983 | De Meyer et al. . | |
| 4,558,712 | * | 12/1985 | Sentoku et al. | 453/17 |
| 4,564,036 | | 1/1986 | Ristvedt . | |
| 4,620,559 | | 11/1986 | Childers et al. . | |
| 4,635,661 | * | 1/1987 | Uematsu et al. | 453/17 |
| 5,080,633 | | 1/1992 | Ristvedt et al. . | |
| 5,141,443 | | 8/1992 | Rasmussen et al. . | |
| 5,607,351 | | 3/1997 | Schwartz . | |
| 5,810,654 | * | 9/1998 | Suzuki et al. | 453/17 |

* cited by examiner

*Primary Examiner*—Robert P. Olszewski
*Assistant Examiner*—Thuy V. Tran
(74) *Attorney, Agent, or Firm*—Ben E. Lofstedt

(57) ABSTRACT

An improved apparatus and method for the delivery, holding, storage, and dispensing of coins, and the like, from coin-operated gaming machines, such as "slot" machines, or the like, into which coins are deposited and, when an award is indicated, coins are dispensed as part of, or all, of the award or prize, is disclosed. After depositing coins in the coin slot of the gaming machine, the coins are typically passed through a coin-counting and delivery mechanism then deposited into one or more coin hoppers located in the front or the rear, or the top or bottom, or to the left or right of the coin counting and moving mechanism in the slot machine. Once deposited into the coin hoppers, the coins can then be dispensed as awards to the gaming machine customer, or, alternatively, further deposited into a coin drop consisting of one or more containers, such as coin bags, mounted beneath the coin hoppers on a motorized carousel thereby improving security and minimizing customer play interruption on payout and coin service intervals.

13 Claims, 4 Drawing Sheets

COIN DELIVERY, STORAGE AND DISPENSING SYSTEM FOR COIN OPERATED MACHINES AND METHOD FOR SAME

BACKGROUND OF THE INVENTION

1. Field of the Invention

The present invention relates to coin or gaming token hoppers or storage systems typically located inside a lockable cabinet in which the gaming machine is also housed, and, more particularly, relates to an improved coin or gaming token hopper system in which, after the coins are counted, are delivered to a coin storage container known as a coin hopper located beneath the coin counting and moving mechanism, but can also be delivered to one or more additional coin hoppers located in front of or to the rear of, above or to the right or to the left of, the coin counting and moving mechanism thereby improving security and minimizing customer play interruption on payout and coin service intervals.

2. Description of the Prior Art

A gaming machine, such as a "slot" machine, or the like, receives coins, paper money, or gaming tokens, and the game is played, and, if the gaming machine registers a win, the gaming machine dispenses one or more coins or gaming tokens into a coin tray accessible to the gaming player as the prize or award. Typically, to play a gaming machine, coins or gaming tokens are first deposited into a coin slot which delivers the coin or token into the gaming machine inside a locked cabinet. Once the coins or tokens are deposited into the gaming machine, the money, in the form of coins, is typically counted and then delivered into a coin hopper located beneath the coin counting and moving mechanism inside a locked, protective cabinet in which the gaming machine and the money is housed. Usually, because of the instant gratification that the gaming customer receives from receiving a prize or an award in the form of coins, the gaming machines will pay out the prize by removing coins from the cache of customer-deposited coins in the coin hopper and thereafterwards discharging these coins into a customer-accessible coin tray located at the front of the gaming machine cabinet.

In the present state-of-the-art gaming machines' coin hopper designs, means are provided for discharging the coins directly from the coin hopper into the coin pay-out tray for receipt by the customer, or game player. Obviously, however, there is a limit to the number of coins that the coin hopper can physically hold, the size and coin-carrying capacity being restricted by the allowable size of the cabinet housing of the gaming machine. The floor space in gaming establishments is so expensive and limited that every square foot of floor space must be productive. As a result, the gaming machine cabinet is limited in size to a specific amount of horizontally-disposed floor space. Consequently, in view of the limitation on the number of coins that can be stored inside a gaming machine due to the gaming machine cabinet size limitations, a significant problem is presented when the volume and frequency of the gaming action must be increased to pay for the sizeable operating costs of the gaming establishments without increasing the size of the gaming establishment. The present invention, both apparatus and method disclosed herein, provides for significant productivity gains of coin-operated gaming machines by increasing the coin-holding and storage capacity of the gaming machines by vertically stacking additional coin-hoppers and coin storage containers without increasing the size of the floor square-footage used by the gaming machine and its cabinet.

One of the major problems faced by the gaming industry is theft of money from the gaming machines. To prevent or deter such theft, gaming machine cabinets are preferably constructed so as to thwart and reduce unauthorized access to the money deposited by gaming machine players and held and stored inside the gaming machine cabinet.

Another way to minimize theft or coin shortages relative to the coins deposited in the gaming machine is to reduce the number of times that the gaming machine must be accessed over a 24 hour period to remove the excess coins deposited into the gaming machines by the players. Such excess coins represent, in part, the profits for gaming machine owners.

Another significant and important method used to reduce losses due to unauthorized coin shortages is to provide a means for depositing a pre-measured, or pre-counted number of excess coins into coin bags to effectively pre-package such excess coins prior to the removal of the bagged coins from the gaming machine cabinet. (The term "excess" coins is used to describe the extra coins which remain after the coin hoppers are all filled to capacity to ensure that in the event of a large win or coin payout that there are sufficient coins to pay out one or more large coin payouts from coins housed within the gaming machine cabinet.) By arranging a number of the coin bags on a turnstile or turntable, several coin bags can be used to receive a large number of coins. By doing so, the number of times during a 24 hour period that the gaming machine cabinet must be unlocked for the purpose of removing the excess coins, is significantly reduced. Still further, the use of standard size coin bags eliminates the additional expense and task of counting the coins again since the value of the coins can be determined by merely counting the coin bags before the coin bags or containers are removed from the gaming machine cabinet; hence, there is no need to individually re-count all the coins in the coin bags again; such can be accomplished simply by weighing the bag of coins, subtracting the tare weight of the coin bag, and dividing the remainder by the weight of each coin.

The prior art uncovered by the inventor herein pertains primarily to coin counting and sorting mechanisms rather than to coin or token-operated gaming machines with multiple coin hoppers. Nevertheless, such coin counting and sorting mechanisms are used as part of a gaming machine and are distant cousins. Similar methods for handling the coins and gaming tokens deposited therein are used today.

The prior art patents discovered by the inventor herein are as follows. U.S. Pat. No. 3,695,279 (Black et al.) relates to a high speed coin counting and sorting mechanism. Various coins of different sizes and values can be counted and sorted by this machine. The coins are deposited into an accumulating receiver 16. Once the bag 30 in FIGS. 1 and 2 is filled, excess coins are deflected by deflector 14 and are directed to an endless belt 26 which returns the coins to the supply for recycling. When the bag is full of the desired number of a particular denomination of coins, a signal light 28 is actuated and the alerts the operator who may then remove the bag or other container 30 from the receiver 16 and replace it with an empty container and then actuate a reset button 32 to restore the deflector 14 to its lower position and initiate the counting and sorting of a new series of coins of that denomination.

U.S. Pat. No. 3,746,211 (Burgess, Jr.) relates to a vibratory quantifying or counting apparatus for determining a numerical quantity of items or articles of similar geometric configuration. It is primarily useful as a means for counting and sorting pills or capsules, but can also be used for counting washers, bolts, coins, etc. The chutes and their arrangement are novel in combination with the gate means for diverting parts or coins or pills after a predetermined number has been reached.

U.S. Pat. No. 4,383,540 (De Meyer et al.) relates to a coin processing machine which employs a coin hopper 19 which empties into a coin splitting chute assembly 25 with divergent spouts 27 and 28 to deliver a half batch of coins to each of two coin sorters 38 and 39 operating in parallel. Following the coin sorting operation, the coins are delivered from the bottom of the coin sorters 38 and 39 to a pair of stationary coin bags 49 for storage and removal.

U.S. Pat. No. 4,620,559 (Childers, et al.) relates to coin sorting and counting apparatus generally indicated at 10. Three coin loading trays 22 are hingedly attached to the funnel 20 by their open end for dumping of a batch of coins in the trays 22 into the funnel 20. The loading tray 22 containing the batch of coins to be processed may be tilted upwardly to dump the coins into the frame 20 by lifting the loading tray upward and pivoting the tray about a hinge 22*a*. Positioned below the funnel 20 is a coin hopper 34 to receive the batch of coins dumped from the loading tray 22 as shown in FIGS. 3 and 5. The hopper 34 is rigidly attached to a queueing head 36 and extends upwardly therefrom. As the coins come through the central opening 35 of the head 36, the coins enter a loading area and encounter the centrifugal force generated by the rotating upper surface of the disc 38. The disc 38 then carries the coins in the queue positioned adjacent to the peripheral rim of the disc 38 to the coin-engaging wheels 60 for sorting by denomination. The coins are hurled over the peripheral rim 40 of the disc 38 by the centrifugal force into a coin-catching device 62. The coins are counted by an electro-optical sense 64 as they are traveling through the air. The flight paths of the coins after they leave the rotating disc 38 are shown by broken-line arrows in FIG. 5. Coin holding tanks 172 are provided for temporarily holding each denomination of coin being sorted. Later, the coins in the holding tank 172 are deposited in the coin-collecting receptacle 86 for than particular denomination of coin. The operator must open the slide gate 178 for the holding tank 172 to transfer the coins in the holding tank to the coin-collecting receptacle 86. The coin-collecting receptacles 86 have an open upper end and are sized to receive a coin bag 188 therein. The coin collecting receptacles 86 are secured to the rotatable carrier plate 82 by a detachable hinge. The operator may open the door 16, rotate the inner frame 68 relative to the stationary base 14, and hence the coin-collecting receptacles 86 on the carrier plate 82 to position the indicated receptacle in the door opening. The carrier plate 82 may be positively locked for prevent unintended rotation when a coin-collecting receptacle 86 is being tilted forward or removed, and to provide a means for indexing to insure the receptacle is properly positioned in the center of the door opening. Each of the holding tanks 172 are removably fixed to the wall 74 by a combination of lug 173 and a removable fastener 175. The discs, quequeing head, sorting wheels, counters, bag receptacles, and coin holding tanks 172 are mounted for rotation with the frame, and may be rotated to selectively bring a bag receptacle to the operator for its removal while the machine is sorting and counting coins. Basically, in this invention, the coin hopper or coin holding tanks are beneath coin loading aperture, and, the coin-collecting receptacles 86 are arranged on the top of a rotatable carrier plate 82, or manually-operable rotating carousel.

None of the above prior art devices or other devices or methods known to the inventor, including those referenced herein, teach or disclose the improved combination of a gaming machine incorporating a multiplicity of coin holders, hoppers or drops, positionally arranged above the coin slot and coin counter, to the rear of the coin counter and hopper, and disposed laterally therefrom. Neither does any of the prior art devices or methods known to the inventor use or incorporate a rotating carousel, disposed below the coin hoppers and adapted to hold a multiplicity of bags or containers for receiving coins. Such a rotating carousel is yet another feature to be incorporated to further enhanced the new and unique features of this new and novel arrangement all of which creates a vastly improved and more productive gaming machine without increasing the size of the floor footprint over previous gaming machine designs.

SUMMARY OF THE INVENTION AND OBJECTS

Fundamentally, the instant invention is an improved coin hopper design for coin-operated gaming or "slot" machines, or the like, which accept coins and dispenses coins as a prize or award. The improved coin hopper design allows the coins to be delivered by the coin-counting and delivery mechanism to the front or, to the rear of the slot machine, to the top or to the bottom of the slot machine, or even to the right or to the left of the slot machine gaming apparatus. In the prior art, delivery of the coins was limited to a coin hopper positioned beneath the coin counting and delivery mechanism. With the new and improved design disclosed herein, the coins can be delivered to a top fill coin hopper or coin reserve arranged above the primary coin hopper to increase the coin holding capacity of the gaming machine which, in turn, permits the gaming machine to dispense a larger number of coins for a payout or award. Further, such a new and unique design significantly improves the potential for a full and complete payout to the anxiously-awaiting customer via a customer accessible coin tray typically mounted at the front of the gaming machine cabinet.

As desired, or selected, the coins can also be discharged from the coin hopper to either the left or to the right side of the coin hopper thereby allowing for greater flexibility in dispensing the coins from the gaming machine. Another benefit produced by this improved coin delivery and coin hopper re-orientation and added coin storage is that such allows for the further incorporation of a carousel. Such a carousel is arranged beneath the coin hopper and is adapted to receive and hold a plurality of coin bags or containers. The use of such a carousel and coin bag/container arrangement substantially increases the number of coins that can be stored inside the locked gaming machine cabinet thereby reducing the number of times during a 24 hour period that the bottom coin drop will require accessed for the removal of the coins in the bottom coin drop.

It is one object of the instant invention to create a improved coin hopper design which allows for a top reserve coin drop to be filled by the coin moving mechanism working in conjunction with the typical coin counter and coin hopper arrangement. Such an improved arrangement allows the coins to be delivered to a storage area above the coin hopper. By the addition of a top reserve coin drop, a larger quantity of coins can be stored for discharge to the customer, improving both the size of the award and significantly increasing the gaming machine's capacity for holding and retaining the coins or tokens that have been deposited into the machine by the players.

A yet still further primary and important object of the instant invention is to provide an improved coin hopper design which incorporates a coin discharge mechanism which may be conveniently arranged to discharge the coins to either the right or the left of the coin hopper.

Another significant object of the within described invention is that when the coins are delivered from the coin counter and delivery mechanism to the first coin hopper and, when, as desired, to any other coin drop or bag or container wherever situated within the gaming machine cabinet.

It is a yet still further object of the invention disclosed and described herein to provide an improved combination coin counter and delivery mechanism and coin hopper device so that the coins can be sent to the bottom coin drop, or into one or more secure, lockable bags or containers mounted therebeneath on a carousel all mounted within the gaming machine cabinet.

It is one further and important object of the invention herein to provide an improved combination coin hopper device which delivers coins to a plurality of bags or containers operably secured on a motorized carousel beneath the coin hopper. Once the bag or container is filled with coins, the motorized carousel rotates to bring another bag or container into position beneath at least one coin discharge guide to be filled with coins. When a bag or container filled with coins is removed from the powered carousel, a locking mechanism can be used to secure the coins in the bag or container thereby preventing unauthorized access to the coins therein. The number of coins in the bag or container can be readily and easily verified by weighing the entire combination of coins and bag or container and then subtracting the weight of the bag or container and then dividing the remaining weight by the individual weight of a single coin or by electronically (mechanical switch or non-contact sensor) counting the coins dispensed to each bag wherein the quantity of coins per bag can be pre-selected and controlled through electronics.

Another important and significant object of the invention disclosed herein is that by depositing more coins in the coin hopper, the more frequent activation of the motor will produce more frequent vibration throughout the system and the coins in the coin hopper will be caused to vibrate more frequently to eliminate stacking of the coins in one area of the coin hopper resulting in a premature overflow of the coins from the coin hopper bowl. This vibrating action increases the actual coin holding capacity of the coin hopper bowl by forcing the coins to be arranged more efficiently and uniformly in the coin hopper bowl.

The foregoing and other objects and advantages of the invention will appear from the following description. In the description, reference is made to the accompanying drawings which form a part hereof, and in which there is shown by way of illustration one preferred embodiment of the invention. Such embodiment does not necessarily represent the full scope of the invention, however, and reference is therefore made to the claims for interpreting the scope of the invention.

DESCRIPTION OF THE PREFERRED EMBODIMENT OF THE INVENTION

One of the significant economic problems faced by gaming establishments, such as casinos, in the use of coin or gaming token-operated gaming machines, is the limited amount of square footage of the floor that is available for use by such gaming machines. This vexing economic and operational problem has now been overcome by the improved method and gaming machine apparatus disclosed herein by increasing the coin-holding capacity of the gaming machine by vertically stacking additional coin hoppers above and/or below the normal, or standard coin hopper within the gaming machine. By doing so, use of the empty, available space within the gaming machine, while limited to some extent, is effectively utilized and does not require an increase in the amount of casino floor space needed for the gaming machine cabinet to occupy. Since floor space is essentially fixed by way of economic limitations in existing gaming establishments, the addition of two coin hoppers or containers results in a 2 to 3 times increase in the coin-holding capacity of each square foot of floor space occupied by the gaming or slot machine without the need to increase the size of the floor space.

PRIOR ART COIN HOPPER SYSTEM DESIGN AND METHOD

Figure 1:
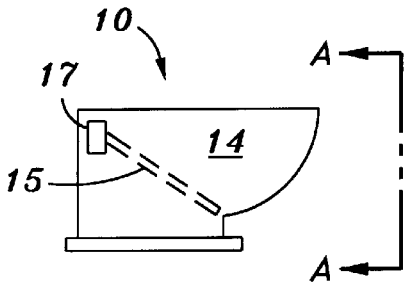
FIG. 1 (PRIOR ART)
FIG. 1 is a front elevational view of the typical prior art coin hoppei designs in the form of a pay out only standard unit.
Figure 2:
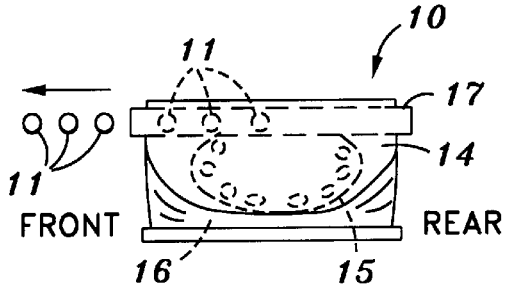
FIG. 2 (PRIOR ART)
FIG. 2 is a top view of the typical prior art hopper design illustrated in FIG. 1.

With continuing reference now to all of the drawings herein, and with particular reference now to FIGS. 1 and 2, there is shown the PRIOR ART COIN HOPPER system design. In the PRIOR ART COIN HOPPER system design, generally shown at 10, incorporates a pay-out only coin hopper design. In FIGS. 1 and 2, the coin hopper is identified by the number 14. FIG. 1 is a side elevational view of the PRIOR ART COIN HOPPER system design. As shown in FIG. 1, the PRIOR ART COIN HOPPER system design includes a coin hopper 14 and a motorized disc 15 which spans the distance between the bottom of the coin hopper 14 and the coin chute 17. With special emphasis now on FIG. 2, the view of the standard PRIOR ART COIN HOPPER system design unit, generally indicated at 10, consists of a coin hopper 14, a motorized disc 15 and a coin chute 17. Inside the coin hopper 14 is a motorized disc 15 with shallow coin receptacles 16 disposed thereabout are each designed for the temporary receiving and holding of a coin or gaming token 11. As shown in FIG. 2, the motorized disc 15 is rotated counterclock-wise, and gathers the coins 11 from the coin hopper 14 by allowing the coins to be deposited into the coin receptacles 16. As the coins 11 are gathered from the bottom of the coin hopper 14 into the shallow receptacles 16 (typically in the peripheral portion of the disc 15), the coins 11 are carried up and then tossed by the centrifugal force developed at the peripheral portion of the motorized disc 15 into the entrance of the coin chute 17 and thereafterwards delivered out the exit of the coin chute 17 located at the FRONT of the coin hopper 14. Typically, after the tossed coin 11 exits the coin chute 17, the coin 11 is deposited into a coin bowl (not shown) which is accessible to the gaming machine player.

As shown and illustrated in FIG. 2, the coins 11 are discharged only from the FRONT or from the REAR, but not both. As can be readily seen, such PRIOR ART COIN HOPPER system design is limited to a single coin hopper and coin discharge arrangement. In short, the PRIOR ART COIN HOPPER system design is limited to a single coin hopper and is originally set up for a single direction of discharge for the coins 11, that is, from the FRONT or the REAR. Coins 11 are then diverted to only a bottom-located coin payout tray accessible to the gaming machine customer (not shown in FIGS. 1 or 2) or to a coin drop not accessible to a gaming machine customer (not shown in FIGS. 1 or 2), located beneath the coin hopper 14. On pay-out, should the PRIOR ART COIN HOPPER system be depleted of its coins 11, a typical occurrence, the customer's ability to continue play is impeded. Obviously, such interruptions of the operation of the gaming machines are highly undesirable because they reduce the income produced by the gaming machines, are labor intensive, and increase the risk of losses due to personnel negligence and theft.

It should be clearly understood and noted that for purposes of the present description, the term "coins" is used solely for convenience to describe both monetary coins and gaming tokens.

NEW AND IMPROVED COIN HOPPER SYSTEM DESIGN AND METHOD

Figure 3:
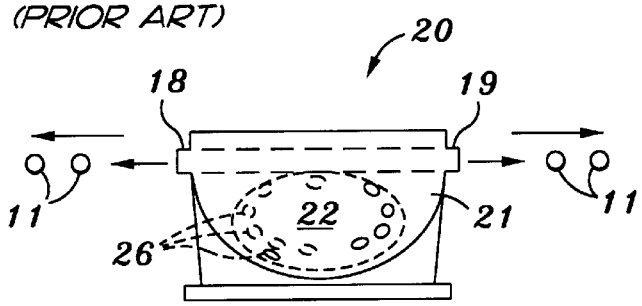
FIG. 3 is a top view of one embodiment of the improved coin hopper design disclosed and described herein.
Figure 4:
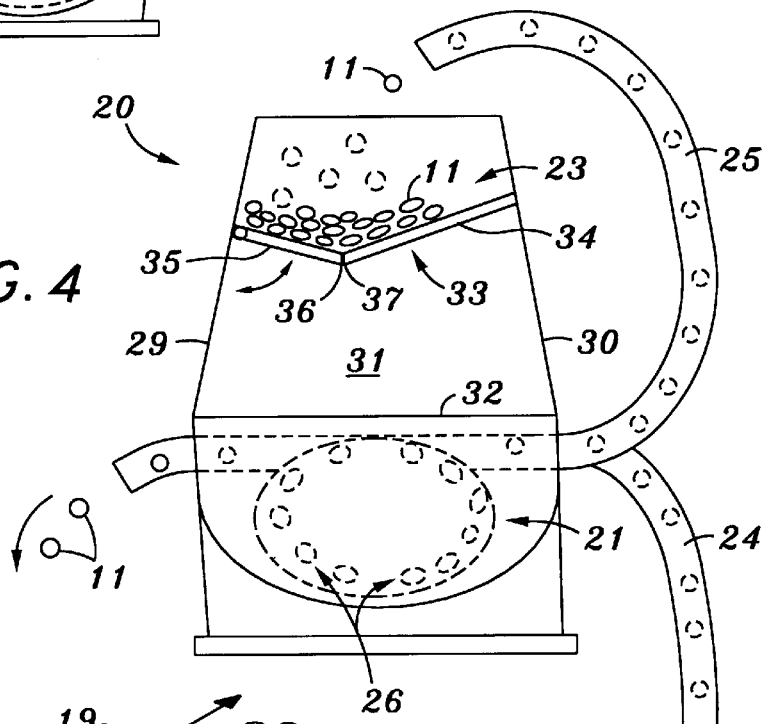
FIG. 4 is a side elevational view of the one embodiment of the improved coin hopper design showing front coin discharge, rear coin discharge to the bottom coin drop and the rear coin discharge to the top coin hopper.
Figure 5:
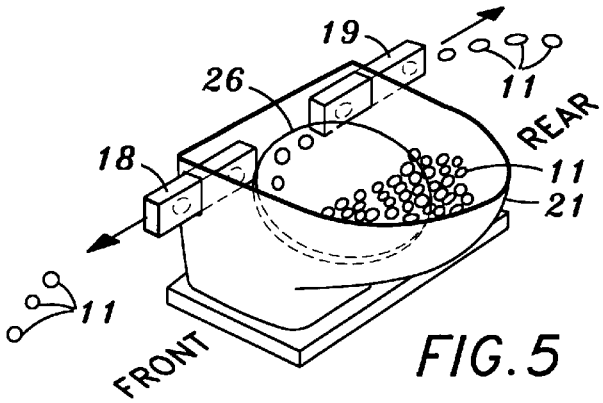
FIG. 5 is a perspective view of the new and improved hopper shown in front elevation in FIG. 3.

With specific reference now to FIGS. 3, 4 and 5, there is described the new and improved coin hopper system design generally indicated at 20 for coin-operated gaming machines. As shown in FIGS. 3 and 5, as part of the new coin hopper system 20 there is shown and illustrated that the coins 11 in the coin hopper 21 being discharged from the coin chutes 18, 19 either to the FRONT or to the REAR of the cabinet.

In the particular example shown and depicted in FIG. 5, when the motorized disc 22 is driven counterclockwise, the coins 11 are picked up in the shallow receptacles 26 and as the disc 22 moves from the bottom to the top of the coin hopper 21, the coins 11 are thrown by centrifugal force into the coin chute 18 which discharges the coins 11 to the FRONT. When the motorized disc 22 is driven clockwise, as the disc 22 moves from the bottom to the top of the coin hopper 21, the coins 11 are lodged in the coin receptacles 26 as the motorized disc 22 moves through the bottom of the coin hopper 21, the coins 11 in the coin receptacles 26 in the disc 22 are thrown by the centrifgal force of the motorized disc 22 into the coin chute 19 which discharges the coins 11 to the REAR. In this particular embodiment of the present invention, whether the coins 11 are discharged through the FRONT coin chute 18 or through the REAR coin chute 19 depends on the direction of the rotation of the motor driving the motorized disc 22 and upon a sufficient rotational velocity to achieve the proper amount of centrifugal force to toss the coins 11 into either one of the entrances to the coin chutes 18, 19 and out the opposite end or exit thereof.

It should be clearly noted at this time that by rotating the coin hopper 21 shown in FIG. 5 ninety degrees, the coin chutes 18, 19 would be oriented to discharge the coins 11 either to the RIGHT or LEFT side of the cabinet 27 rather than to the FRONT and the REAR.

Turning now to FIG. 4, there is illustrated the new and improved coin hopper system design generally indicated at 20 for coin-operated gaming machines including an second coin hopper 23 vertically disposed above the first coin hopper 21. When the motorized disc 22 is caused to rotate in a counter-clockwise direction, the disc 22 moves through the coin hopper 21 from the bottom to the top, and as it does so, it picks up coins 11 in its plurality of coin receptacles 26 and just after it emerges from the coins 11 in the coin hopper 21, the coins 11 are tossed depending on the rotational velocity of the motorized disc 22 either into the entrance to the coin chute 24 which directs and delivers the coins 11 from the coin hopper 21 to the bottom coin drop (not shown in FIG. 4) or into the entrance of the coin chute 25 which channels the coins 11 from the coin hopper 21 to the second coin hopper 23. Of course, other means such as selectively alternating the entrances of the coin chutes 24, 25 into alignment with the stream of coins 11 as the coins 11 are being launched from the coin receptacles 26 on the motorized disc 22 following the emerging from the top of the stack of coins 11 in the coin hopper 21. By placing the coin chutes 24 arid 25 to the front of the hoppers 21 and 23, the need for a reversible motor in hopper 21 is eliminated.

Figure 6:
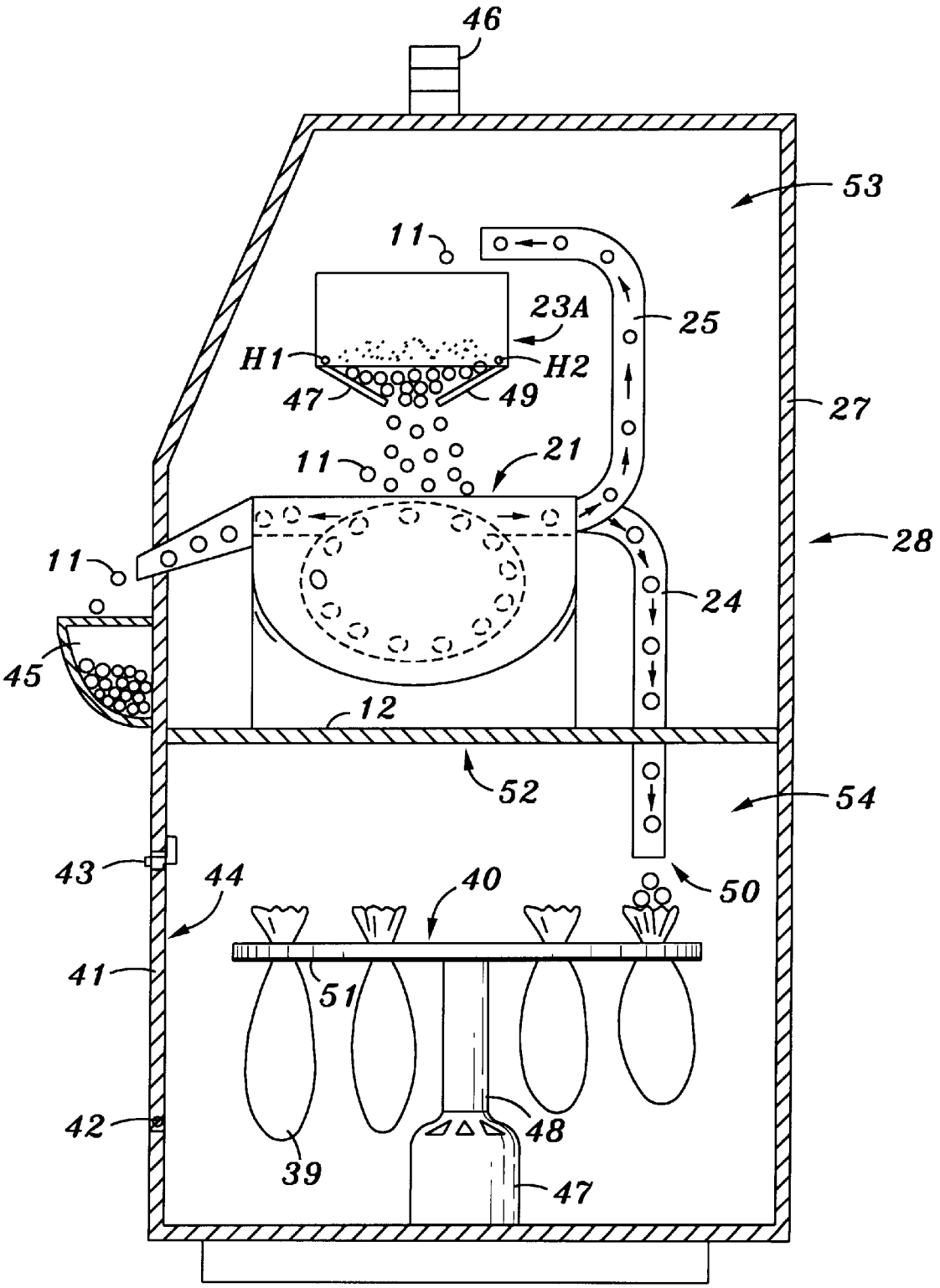
FIG. 6 is a side elevational view, shown partially in section, of one embodiment of the improved coin hopper design illustrating the combination of a bottom coin drop and a top fill.
Figure 7:
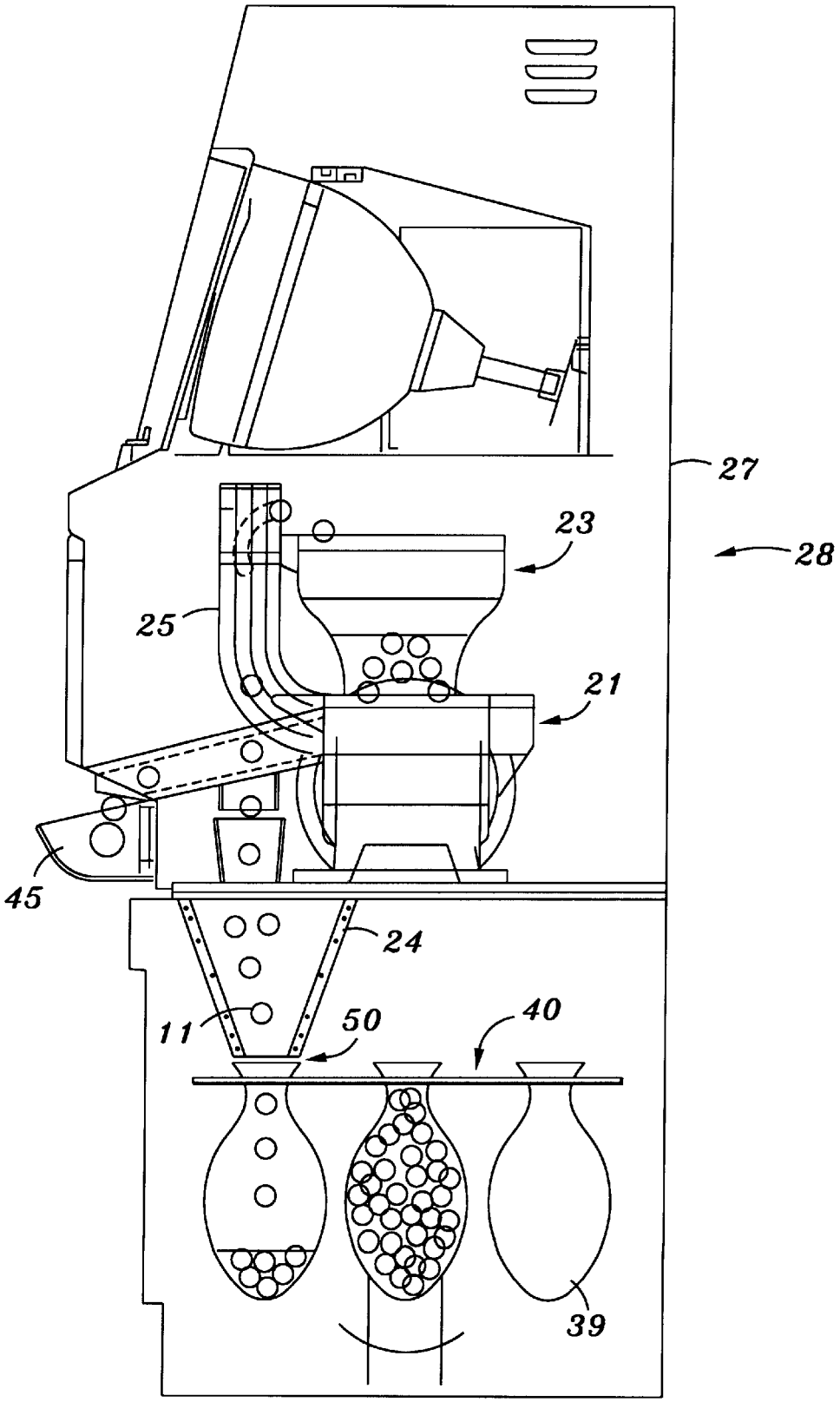
FIG. 7 is a side elevational view, shown partially in section, of one embodiment of the invention herein depicting a front coin delivery: system from the first coin hopper to the second coin hopper and the carousel coin drop.
Figure 8:
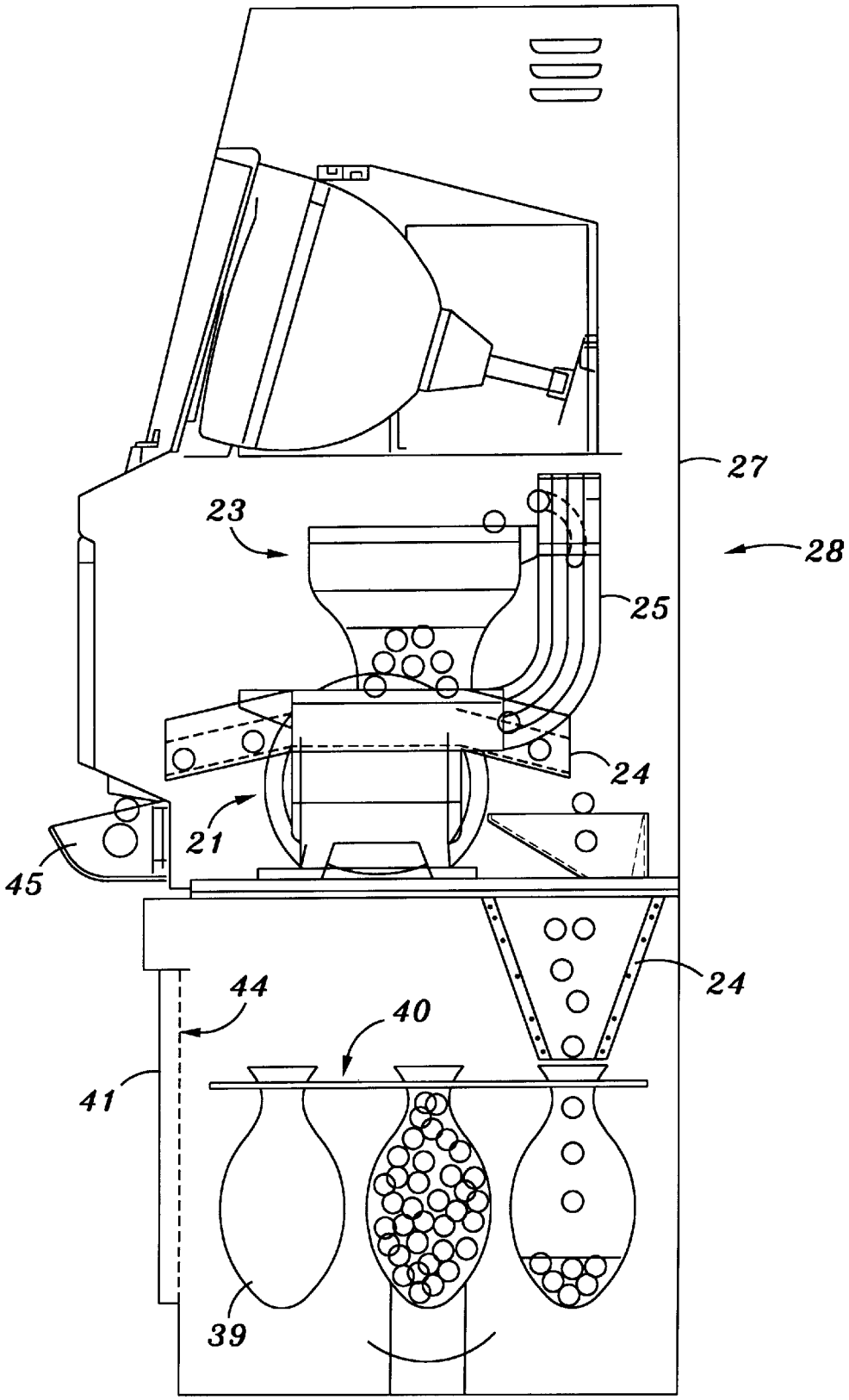
FIG. 8 is a side elevational view, shown partially in section, of one embodiment of the invention herein depicting a rear coin delivery system from the first coin hopper to the second coin hopper and the carousel coin drop.

As previously noted, the addition of a second coin hopper 23 doubles the coin-holding capacity of the gaming machine generally indicated at 28 in FIG. 6. One method utilized in the interoperable functioning of the first coin hopper 21 and the second coin hopper 23 is to allow the coins 11 to first fill the first coin hopper 21. After the first coin hopper 21 is filled as determined by either counting the coins 11 as the coins 11 are deposited into the coin slot of the gaming machine 28, or by pre-weighing the first coin hopper 21 to determine the tare (or empty) weight of the first coin hopper 21 and subtracting the tare weight from the combined weight of the coins 11 in the first coin hopper 21 to determine the total weight of the coins 11 deposited in the first coin hopper 21. Weighing could be accomplished a number of different ways. One way is to incorporate a simple electronic scale into the base 12 of the first coin hopper 21 coupled to a simple digital electronic digital or analog displays such as created using one or more LEDs (Light Emitting Diodes) or LCDs (Liquid Crystal Displays). Another way would be utilize a standard mechanical weight scale. Since the coins 11 are of a single denomination, size and weight, it would be a relatively easy matter to precisely determine the exact number of coins contained in the first coin hopper 21 at any given time. Alternatively, the primary coin hopper 21, would contain two (2) sets of conductive probes, a high and low position, wherein the "low" set would direct the filling of said primary hopper from the secondary hopper 23. A typical method for counting the coins involves the use of electrically conductive probes wherein the coins complete the electronic circuit thereby creating a pulse of electricity. The number of electrical pulses are counted by a standard electrical pulse counter which indicate the number of coins that have passed through the electrically conductive probes on the way to the coin hoppers. The "high" set would effect a transfer of coins from the primary hopper 21, the secondary hopper 23 wherein the secondary hopper 23, also contains a set of conductive probes which control its volume of coins and in a "high" position would cause the primary hopper 21 to direct the coins 11 to the coin drop or a plurality of coin bags located in the base of the gaming machine. If, when replenishing the primary hopper 21 from the secondary hopper 23, the volume of coins dispensed from hopper 23, does not satisfy the coin payout requirement, the gaming machine is set to inactive and service is required to replenish the primary hopper 21 with coins 11.

With reference once again to FIG. 4, the second coin hopper 23 is arranged to be disposed vertically above the first coin hopper 21. Such second coin hopper 23 is mounted above the first coin hopper 21 by a plurality of typically four walls, of which three walls are shown in FIG. 4; namely, 29, 30, 31. The fourth wall is oppositely disposed from wall 31. All four walls are joined along their vertical edges. The bottom portions of these four walls are secured to the top 32 of the first coin hopper 21. The second coin hopper 23 is formed by the upper portions of the four walls 29, 30, 31 (the $4^{th}$ wall directly opposite of wall 31 is not shown in the drawing of FIG. 4) and by a floor portion generally indicated at 33. The floor portion 33 is formed by a pair of floor members 34, 35 which are each set at an downward sloping angle towards the downwardmost edges 36, 37 of the floor members 34, 35 respectively. One of the floor members 34 is fixed; the other floor member 35 is hinged at (A) where it is attached to the wall 30. The floor member 35 is opened and closed electrically and/or mechanically controlled by a conventional hinge control system as desired. As the coins 11 are delivered from the first coin hopper 21 via the coin chute 25, the coins 11 exit therefrom and are deposited into the second coin hopper 23 and, when the floor member 35 is held closed as depicted in FIG. 4 by the hinge pivoting control system, the coins 11 accumulate in the second coin hopper 23. When both the first coin hopper 21 and the second coin hopper 23 are both filled to their respective maximum capacities, any additional coins 11 deposited into the gaming machine 28 into the first coin hopper 21 are delivered into the entrance to the coin chute 24 and delivered into a bottom coin drop (not shown) or into the coin bags 39 mounted on a carousel as shown and illustrated in FIG. 6. Once delivered to the bottom coin drop typically a box with an opening into the top, or into the coin bags 39, such coins 11 are not available for distribution as an award or prize to the gaming machine customer. When the bottom coin drop, or coin bags 39, are filled, the bottom coin drop, or coin bags 39, are removed by authorized personnel permitted access into the gaming machine cabinet 27 via a door 41 covering an opening 44 into the cabinet 27 matchably mated to the peripheral contour of the door 41. The door 41 is mounted to the cabinet 27 via a hinge 42. A lock 43 is secured to the door 41 for locking the door 41 to the cabinet 27 when the door 41 is closed to cover the opening 44 into the gaming machine cabinet 27.

In the event that the gaming customer wins a very large number of coins 11 beyond the coin-holding capacities of either the first coin hopper 21 or the second coin hopper 23, the coins 11 in the first coin hopper 21 are first delivered into the coin chute 18 for deposit into a gaming customer-accessible tray 45 such as depicted in FIG. 6. It should be noted, at this time, that the coin-holding capacity of tray 45 is typically larger than the combined coin-holding capacities of the first coin hopper 21 and the second coin hopper 23. Once nearly all of the coins 11 in the first coin hopper 21 are removed and delivered to the customer-accessible tray 45, the hinge control system is activated to allow the floor member 35 to be opened and to allow the downwardmost edge 37 to be disengaged from the downwardmost edge 36 of the fixed floor member 34 thereby allowing the coins 11 in the second coin hopper 23 to be dropped from the second coin hopper 23 directly into the first coin hopper 21 and filling the first coin hopper 21. Once the first coin hopper 21 is filled, the motorized disk 22 is rotated counter-clockwise to deliver the coins 11 into the entrance to the coin chute 18 and out the exit thereof into the customer-accessible coin receptacle 45 to present the customer with his or her winnings.

Turning now to FIG. 6, there is shown and illustrated a gaming machine 28 and cabinet 27 containing the new and improved coin delivery, storage and dispensing system as previously described herein.

Mounted on top of the cabinet 27 is a towerlight 46 containing a plurality of different colored lights. The towerlight 46, when triggered "ON", provides a visual indication by way of a colored and/or blinking light that the customer operating this particular gaming machine 28 has won a particular size award. One of the colored lights, or even a WHITE (uncolored) light, can be turned "ON" independently of the other lights in the towerlight 46 to signal to the owners of the gaming machine 28 that the gaming machine customer needs assistance.

The gaming machine cabinet 27 is divided internally into at least two different sections; the top section, generally indicated at 53, houses a plurality of coin hoppers 21, 23A and the bottom section, generally indicated at 54, houses a coin drop. A support means is typically used to support the coin hoppers 23A and 21 in the form of a shelf 52 mounted to the cabinet 27.

As shown in the top section of the gaming machine cabinet 27 of FIG. 6, there are two coin hoppers. The first coin hopper is 21; the second coin hopper is 23A. The operation of the first coin hopper 21 has been previously discussed herein. Coins are deposited into the first coin hopper 21 when the gaming machine customer feeds the coins 11 into a coin slot (not shown) typically mounted in the front part of the gaming machine cabinet 27 where the gaming customer accessible coin holding tray 45 is located. When the first coin hopper 21 is filled to capacity any additional coins 11 are moved either to the second coin hopper 23A disposed in the top section of the cabinet 27 or to the coin drop located in the bottom section of the cabinet 27. Delivery of the coins 11 to the second coin hopper 23A is accomplished via the coin-chute 25 and delivery of the coins 11 to the coin drop is arranged by passing the coins 11 through the coin chute 24.

The second coin hopper 23A is secured to the cabinet 27 and disposed above the first coin hopper 21. The second coin hopper 23A, as shown, is depicted in the form of an alternate arrangement and configuration to the second coin hopper 23 shown in FIG. 4. The second coin hopper 23A consists of a pair of hinged floor members 47 and 48 which are pivotally hinged at H1 and H2 respectively. When the floor members 47 and 48 are horizontally arranged with each of their respective forwardmost edges either in intimate opposing relationship to one another, or are arranged in operative overlapping relationship with each other and are deemed to be "CLOSED". When in the "CLOSED" position, the floor members 47 and 48 are cooperatively arranged to form a continuous floor for the second coin hopper 23 so that when coins 11 are deposited therein, the floor members 47 and 48 will cooperatively hold and retain the coins 11 deposited in the second coin hopper 23. At any time when the second coin hopper 23A contains coins 11, should it be desired to do so, the hinged floor members 47 and 48 can be powered to their "OPEN" position which is accomplished as the floor members are powered from their respective horizontal positions to their respective vertical positions. Once the hinged floor members 47 and 48 are moved downwardly away from their horizontal positions, the coins 11 are allowed to drop downwardly into the open top portion of the first coin hopper 21.

The hinged floor members 47 and 48 can be controlled by any number of conventional power control and hinge door opening systems which are well-known and available via the prior art. Typically, for this application the hinged floor members 47 and 48 can be powered and positionally-controlled by an electrically powered system.

The particular coin drop illustrated in FIG. 6 consists of a motor-driven carousel generally indicated at 40. This carousel arrangement 40 also incorporates a turntable 51 having receptacles for receiving and holding a plurality of coin bags 39. An electric motor 47 is mechanically coupled with the turntable 51 via a shaft 48. When electricity is applied to the electric motor 47 by turning the motor 47 "ON", the motor 47 turns and drives the shaft 48 coupled to the turntable 51, thereby causing the turntable 51 to rotate about the shaft 48 of the motor 47. When the turntable 51 rotates, one of the coin bags 39 held by the bag-holding receptacle in the turntable 51, is caused to be rotated into a position so that the entrance to the opening 49 of the coin bag 39 is operably positioned beneath the exit or outlet 50 of the coin chute 24 to allow the coin bag 39 to receive the coins 11 exiting therefrom. When in position, the electric motor 47 is turned "OFF" by disconnecting the source of electricity thereto typically by means of an electric switch or an electronic motor speed control unit. Once the coin bag 39 is filled with coins 11, which can be determined by counting the number of coins 11 deposited therein through the use of conventional photo-electric coin-counting devices mounted in the coin chute 24, the electricity to the motor (not shown) which drives the disk 22 is turned "OFF" and the motor driving the disk 22 stops causing the disk 22 to stop rotating. When the motor-driven disk 22 stops, the coins 11 are no longer delivered into the coin chute 24 and thereafterwards into the coin bag 39 which has been filled to its capacity with coins 11. When the coin-counting mechanism mounted in the coin-chute 24 detects that no coins 11 are being delivered into the coin chute 24 and passing therethrough, the electrical power to the motor 47 is turned "ON" and the motor 47 rotates the turntable 51 to move the filled coin bag 39 away from it's coin-receiving position. As this is being accomplished, the next coin bag 39 which is empty, is moved into the position formerly occupied by the coin bag 39 filled with coins 11. Once the entrance to the empty coin bag 39 is operably positioned beneath the exit or outlet 50 of the coin chute 24 to allow the coin bag 39 to receive the coins 11 exiting therefrom, the electric power to the motor 47 is turned "OFF" and the motor 47 stops thereby stopping the turntable 47. Once this is accomplished, electricity is applied to the motor (not shown) which drives the disc 22 and as the disc 22 begins to rotate, the coins 11 are again delivered into the coin chute 24 and into the empty coin bag 39, and the processing sequence again repeats itself until all of the coin bags 39 are filled with coins 11. Once all of the coin bags 39 are filled with coins 11, the owner/operator of the gaming establishment is notified by an electronic signal, or otherwise, such as a flashing towerlight 46, and personnel are dispatched to the site of the gaming machine. Once the authorized personnel arrive at the gaming machine cabinet 27 and the lock 43 on the cabinet door 41 is opened, access to the lower portion of the cabinet 27, the carousel 40 and the coin bags 39 is provided. The coin bags 39 are locked and removed from the turntable 51 and thereafterwards deposited in a locked container or strongbox which the authorized personnel have brought with them to the gaming machine. Empty coin bags 39 are mounted in the turntable 51, and the door to the cabinet 27 shut and locked to prevent unauthorized entry thereinto.

One of the most significant improvements of this new and improved coin hopper configuration is that the coin holding capacity of the gaming machine is greatly increased over the prior art single coin hopper and coin drop design. By this new and improved arrangement, the frequency of coin filling of the primary hopper 21, located in the gaming machine cabinet 27, is significantly reduced thereby reducing the cost of labor involved in maintaining and servicing the gaming machine and its operation. Also, by reducing the frequency of coin filling, the opportunity for coin shortages due to negligence and/or theft is significantly reduced.

Further, since one method for determining the operational cost of a casino or gambling establishment is on a income/cost-per-square foot of floor space analysis relative to the building housing such a business operation, with the improved potential for larger coin payouts, the opportunity is created for reducing the cost per square foot of gaming machine floor space by increasing the gross income per each coin-operated gaming machine.

One of the improvements offered by this new and novel coin hopper design is that coins can be discharged from either or both the front and the rear of the coin hopper. With such front and/or rear coin discharge arrangement, where front discharge is the preferred method, the coin hopper is capable of performing other important and significant functions such as:

1. It allows a top reserve coin drop or second coin hopper 23 (FIG. 4) and coin hopper 23A (FIG. 6) to be filled with coins thereby, at least doubling, the coin payout capacity of the gaming machine cabinet 27 without increasing the amount of floor space taken up thereby. Such an arrangement allows the coins to be delivered to storage located ABOVE the traditional bottom coin hopper. By the addition of a top reserve coin drop in the form of a second coin hopper 23 as illustrated in FIG. 4 or the second coin hopper 23A such as shown in FIG. 6, a significantly larger quantity of coins can be stored for discharge to the customer as an award or "payout" as previously disclosed herein.
2. This improvement allows extra coins to be sent to the bottom coin drop such as generally indicated in FIG. 6 for either collection or to be reused as part of a discharge or award to the gaming machine player.
3. The coin discharge may be conveniently arranged either as a right or a left hand discharge.
4. When the coins are sent to the bottom coin drop or to the top coin drop, the coins will be accurately counted by photo-electric coin counters mounted in the coin chutes.
5. When the coins are sent to the bottom coin drop, the coins can be placed in a secure, lockable bag 39 or other container. A plurality of bags 39 or containers can be operably secured and mounted on a motorized carousel 40. Once one or more bags 39 are filled with coins 11, the motorized carousel 40 can rotate to position empty coin bags 39 secured to the turntable 51 to be filled with coins 11. When a bag 39 of coins 11 is removed from the carousel 40, a lock (not shown) will be activated thereby securing the coins 11 in the bag 39 to prevent any premature removal of coins 11 from the coin bags 39 except by authorized personnel having the keys to unlock such coin bags 39.
6. By depositing more coins 11 in the coin hoppers, such as 21, the coins 11 in the coin hopper 21 will be caused to vibrate much more which will prevent the coins 11 from stacking in one area of the coin hopper 21 which could, and often does, result in the coins 11 overflowing the coin hopper bowl 21. This vibrating action increases the actual coin holding capacity of bowl of the coin hopper 21 by moving the coins 11 into a more compact arrangement inside the coin hopper 21.

7. This improved design allows for the elimination of the mechanical coin diverting mechanism typically located adjacent the coin comparator and, thereby, provides for greater utilization of the cabinet's space. Since the coin diverter is not required to divert or send the coins to the coin drop, the coins, when fed into the gaming machine pass through the comparator, bad or counterfeit coins and/or slugs, are directed back to the customer at the front of the cabinet 27, and accepted coins are dispensed into the primary hopper 21.
8. This improved arrangement also allows the coin bowl of the coin hopper 21 to be located under the coin comparator because the coin chute-to-bottom coin drop is eliminated. This also increases the coin holding capacity of the gaming machine cabinet 27.

As has been previously described and shown herein, this improved design allows it to operate in several additional modes, such as a:

1. STANDARD MODE—as found and illustrated in the prior art arrangement described hereinbefore;
2. TOP FILL MODE—to move the coins 11 deposited by the customer to a TOP COIN DROP (described herein as second coin hopper such as depicted as 23 in FIG. 4 or in 23A in FIG. 6) to provide additional storage of coins for a larger payout to the customer by operating the trap door, such as the floor member 35 in FIG. 4, to deposit more coins 11 into the first coin hopper 21 below in FIGS. 4 and 6.
3. BOTTOM FILL MODE—to move the coins 11 deposited by the customer to a bottom coin drop to provide for storage of coins 11 in coin bags 39 mounted on a motorized carousel 40.
4. RIGHT or LEFT COIN DISCHARGE: Allows the coins 11 to be discharged either to the right or to the left hand side of the first coin hopper 21.

While the invention described and detailed herein is susceptible to various modifications and alternative forms, specific embodiments thereof have been shown by way of example in the drawings. It should be understood, however, that it is not intended to limit the invention to the particular forms disclosed, but, on the contrary, the intention is to cover all modifications, equivalents, and alternatives falling within the spirit and scope of the invention as defined by the appended claims.

What I claim as my invention is:

1. An improved coin hopper apparatus for a coin-operated gaming machine in which the customer-deposited coins can be selectably dispensed therefrom to the gaming machine customer or retained inside the gaming machine in response to a gaming control mechanism actuated by the gaming customer, comprising:

(a) a first coin hopper adapted to receive coins;

(b) a second coin hopper adapted to receive coins and operably disposed above the first coin hopper;

(c) a coin delivery device for delivering coins from the first coin hopper to the second coin hopper and a second coin delivering device for delivering coins from the second coin hopper to the first coin hopper.

2. The improved coin hopper apparatus of claim 1, wherein the customer-deposited coins into the coin-operated gaming machine are delivered first to the first coin hopper.

3. The improved coin hopper apparatus of claim 1, wherein the second delivery device comprises at least one member moveable between an open position and a closed position, said at least one member in said open position permitting the coins stored in the second coin hopper to operatively drop into the first coin hopper.

4. The improved coin hopper apparatus of claim 1 further including a coin receiver disposed beneath said coin delivery devices.

5. The improved coin hopper apparatus of claim 4 wherein said coin receiver is a container having a non-rigid sidewall.

6. The improved coin hopper apparatus of claim 4 wherein said coin receiver is a container having rigid sidewalls.

7. The improved coin hopper apparatus of claim 4 wherein said coin receiver consists of:

(a) a plurality of containers for receiving coins;

(b) a motor;

(c) a carousel device operably coupled to said motor, said carousel device having a plurality of receptacles therein for operably receiving and holding said containers for receiving coins.

8. A method of receiving, delivering, sorting and storing coins deposited into a coin-operated gaming machine housed within a cabinet, comprising the steps of:

(a) receiving the coins into a first coin hopper;

(b) selecting coins to be delivered from the first coin hopper to a second coin hopper;

(c) delivering the selected coins from the first coin hopper to the second coin hopper disposed above the first coin hopper;

(d) selecting coins to be delivered from the first coin hopper to a coin storage drop disposed beneath the first and second coin hopper; and (e) delivering the selected coins to be delivered from the first coin hopper to the coin storage drop disposed beneath the first and second coin hopper.

9. The method of claim 8, further including the step of delivering the coins from the second coin hopper to the first coin hopper.

10. An improved coin hopper apparatus, comprising:

(a) a first coin hopper adapted to receive coins;

(b) a second coin hopper adapted to receive coins and operably disposed above the first coin hopper; and (c) a coin delivery device for delivering coins from the first coin hopper to the second coin hopper.

11. The improved coin hopper apparatus of claim 10, including a coin delivery device for delivering coins from the second coin hopper to the first coin hopper.

12. The improved coin hopper apparatus of claim 11, wherein the coin delivery device for delivering coins from the first coin hopper to the second coin hopper comprises at least one member moveable between an open position and a closed position, said member in said open position permitting the coins stored in the second coin hopper to operatively drop into the first coin hopper.

13. An apparatus for receiving, delivering, sorting and storing coins deposited into a coin-operated gaming machine housed within a cabinet, comprising:

(a) a first coin hopper means, (b) a second coin hopper means;

(c) means for delivering coins from the first coin hopper means to the second coin hopper means disposed above the first coin hopper means;

(d) means for selecting coins to be delivered from the first coin hopper means to a coin storage drop disposed beneath the first coin hopper means and the second coin hopper means; and (e) means for delivering the selected coins to be delivered from the first coin hopper means to the coin storage drop disposed beneath the first and second coin hopper means.

* * * * *